US007197262B2

(12) United States Patent
Itabashi

(10) Patent No.: US 7,197,262 B2
(45) Date of Patent: Mar. 27, 2007

(54) ATTACHABLE/DETACHABLE TRANSFER DEVICE, AN ATTACHABLE/DETACHABLE CARTRIDGE AND AN IMAGE FORMING APPARATUS

(75) Inventor: Nao Itabashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/075,815

(22) Filed: Mar. 10, 2005

(65) Prior Publication Data

US 2005/0214025 A1 Sep. 29, 2005

(30) Foreign Application Priority Data

Mar. 29, 2004 (JP) ..... 2004-096228

(51) Int. Cl.
*G03G 15/08* (2006.01)
*G03G 21/18* (2006.01)

(52) U.S. Cl. ..... 399/113; 399/121

(58) Field of Classification Search ..... 399/113, 399/121

See application file for complete search history.

(56) References Cited

U.S. PATENT DOCUMENTS 5,103,261 A * 4/1992 Matsuo et al. ..... 399/112
5,371,575 A * 12/1994 Sekino et al. ..... 399/113
6,594,459 B2 * 7/2003 Kamano et al. ..... 399/113
6,941,093 B2 * 9/2005 Park et al. ..... 399/121
2003/0063921 A1 * 4/2003 Saito et al. ..... 399/121

FOREIGN PATENT DOCUMENTS

| | | |
|---|---|---|
| JP | 10-142969 | 5/1998 |
| JP | 11-24453 | 1/1999 |
| JP | 2001-100550 | 4/2001 |
| JP | 2001-166613 | 6/2001 |
| JP | 2001-201960 | 7/2001 |

* cited by examiner

*Primary Examiner*—David M. Gray
*Assistant Examiner*—Ruth N. LaBombard
(74) *Attorney, Agent, or Firm*—Oliff & Berridge, PLC

(57) ABSTRACT

An attachable/detachable transfer device, an attachable/detachable cartridge and an image forming apparatus that can employ the attachable/detachable transfer device and/or the attachable/detachable cartridge are provided. The transfer device and the cartridge are attachable to and detachable from each other as well as the image forming apparatus. The cartridge includes an image holding member. The transfer device includes a transfer body, a supporting member, which supports the transfer body, and a connector. The connector is provided on the supporting member and detachably connects the supporting member and the attachable/detachable cartridge together.

26 Claims, 10 Drawing Sheets

ATTACHABLE/DETACHABLE TRANSFER DEVICE, AN ATTACHABLE/DETACHABLE CARTRIDGE AND AN IMAGE FORMING APPARATUS

CROSS REFERENCE TO RELATED APPLICATION

This application claims priority from JP 2004-096228, filed Mar. 29, 2004, the subject matter of which is incorporated herein by reference in its entirety.

BACKGROUND

The invention relates to an image forming apparatus, a process cartridge, and a transfer device unit.

Some image forming apparatus, such as laser printers, include a transfer roller that is fixed to a body casing of the image forming apparatus, and a process cartridge that includes an image holding body. The process cartridge can be attached to and detached from the image forming apparatus through an opening provided in the body casing of the image forming apparatus. The attachable/detachable feature of the process cartridge allows the process cartridge to be replaced with another (e.g., new) process cartridge. The process cartridge may be replaced when, for example, low quality images are being formed because the process cartridge is not functioning properly (e.g., the process cartridge is out of developing agent and/or the image holding body is damaged). In some cases, however, there may be a need to replace the transfer roller if, for example, the transfer roller is damaged and thus, low quality images are being formed.

Japanese Laid-Open Patent Publication No. 2001-100550 discloses an image forming apparatus that attachably/detachably accommodates each of a process cartridge and a transfer roller. The attachable/detachable process cartridge and the attachable/detachable transfer roller are independently attached to and removed from the image forming apparatus by way of an opening in a body casing of the image forming apparatus. The attachable/detachable process cartridge and the attachable/detachable transfer roller are respectively attached to and removed from a predetermined process cartridge position and a predetermined transfer roller position of the image forming apparatus.

In the structure disclosed in Japanese Laid-Open Patent Publication No. 2001-100550, however, the predetermined transfer roller position is a narrow space deep inside the image forming apparatus (e.g., far from the opening in the body casing of the image forming apparatus). Thus, it is difficult to attach and detach the transfer roller to and from the predetermined transfer roller position.

SUMMARY

In other cases, the transfer roller is integrally included as part of an attachable/detachable process cartridge, and thus the transfer roller is replaced when the attachable/detachable process cartridge is replaced irrespective of whether the transfer roller needs to be replaced. If it is only necessary to replace the transfer roller or only the image holding body, for example, such a process cartridge which integrally includes the transfer roller and the image holding body gives rise to increased cost and waste. Higher cost and waste may result because a user is required to replace both the transfer roller and the image holding body even though one of them may still be in good condition.

Handling transfer rollers by themselves can be difficult, however, because transfer rollers are generally mechanically weak and sensitive members that can be damaged easily. If a surface of the transfer roller is damaged (e.g., an undesirable indentation is formed on the surface of the transfer roller, or fingerprint marks are formed thereon), the performance of the transfer roller will be hindered, and the quality of the images formed therewith may be reduced. Thus, during attachment/detachment of the transfer roller, any contact with the surface of the transfer roller should be avoided. More specifically, for example, during attachment/detachment of the transfer roller to/from the image forming apparatus, fingers or components of the image forming apparatus should not touch the surface of the transfer roller.

This requirement of avoiding any contact with the surface of the transfer roller is aggravated, however, by the size of the opening in the image forming apparatus through which the transfer roller must pass in order to reach the transfer roller position. Further, the size of the opening, for attaching and detaching the process cartridge and transfer roller to an image forming apparatus, is becoming smaller as smaller image forming apparatus are being manufactured. Thus, it is becoming even more difficult to provide a transfer roller that can be attached to and detached from an image forming apparatus without damaging the transfer roller during the attaching/detaching process.

According to one aspect of the invention, an image forming apparatus including an attachable/detachable process cartridge and an attachable/detachable transfer device is provided. The process cartridge includes an image holding member and a first connector portion. The process cartridge is attachable to and detachable from the image forming apparatus. The transfer device includes a transfer body, for transferring a developer image formed on the image holding member to a recording medium, a supporting member for supporting the transfer body, and a second connector portion. The transfer device is attachable to and detachable from the image forming apparatus, and the transfer device is attachable to and detachable from the process cartridge by connecting and disconnecting the first connector portion from the second connector portion.

According to another aspect of the invention, an attachable/detachable cartridge that is attachable to and detachable from an image forming apparatus that employs an attachable/detachable transfer device is provided. The cartridge includes a frame, an image holding member that is rotatably supported on the frame, and a connector that is provided on the frame for detachably connecting the frame and the transfer device.

According to another aspect of the invention, a transfer device that is attachable to and detachable from an image forming apparatus that employs an attachable/detachable cartridge and a restricting member is provided. The transfer device is also attachable to and detachable from attachable/detachable cartridge. The restricting member selectively restricts movement of the transfer device when the transfer device is attached to the image forming apparatus. The attachable/detachable cartridge includes an image holding member. The attachable/detachable transfer device is useable for transferring a developer image formed on the image holding member onto a recording medium. The transfer device includes a transfer body, a supporting member, and a connector. The supporting member supports the transfer body. The connector is provided on the supporting member and detachably connects the supporting member and the attachable/detachable cartridge together.

For a better understanding of the invention as well as other aspects and further features thereof, reference is made to the following drawings and descriptions.

BRIEF DESCRIPTION OF THE DRAWINGS

Exemplary embodiments of the invention will be described in detail with reference to the following figures wherein.

DETAILED DESCRIPTION OF EXEMPLARY EMBODIMENTS

Throughout the following description, numerous specific concepts and structures are set forth in order to provide a thorough understanding of the invention. The invention can be practiced without utilizing all of these specific concepts and structures. In other instances, well known elements have not been shown or described in detail, so that emphasis can be focused on the invention.

Exemplary embodiments of the invention will be described with reference to the accompanying drawings. An exemplary embodiment will be described with reference to FIGS. 1 to 7.

Figure 1:
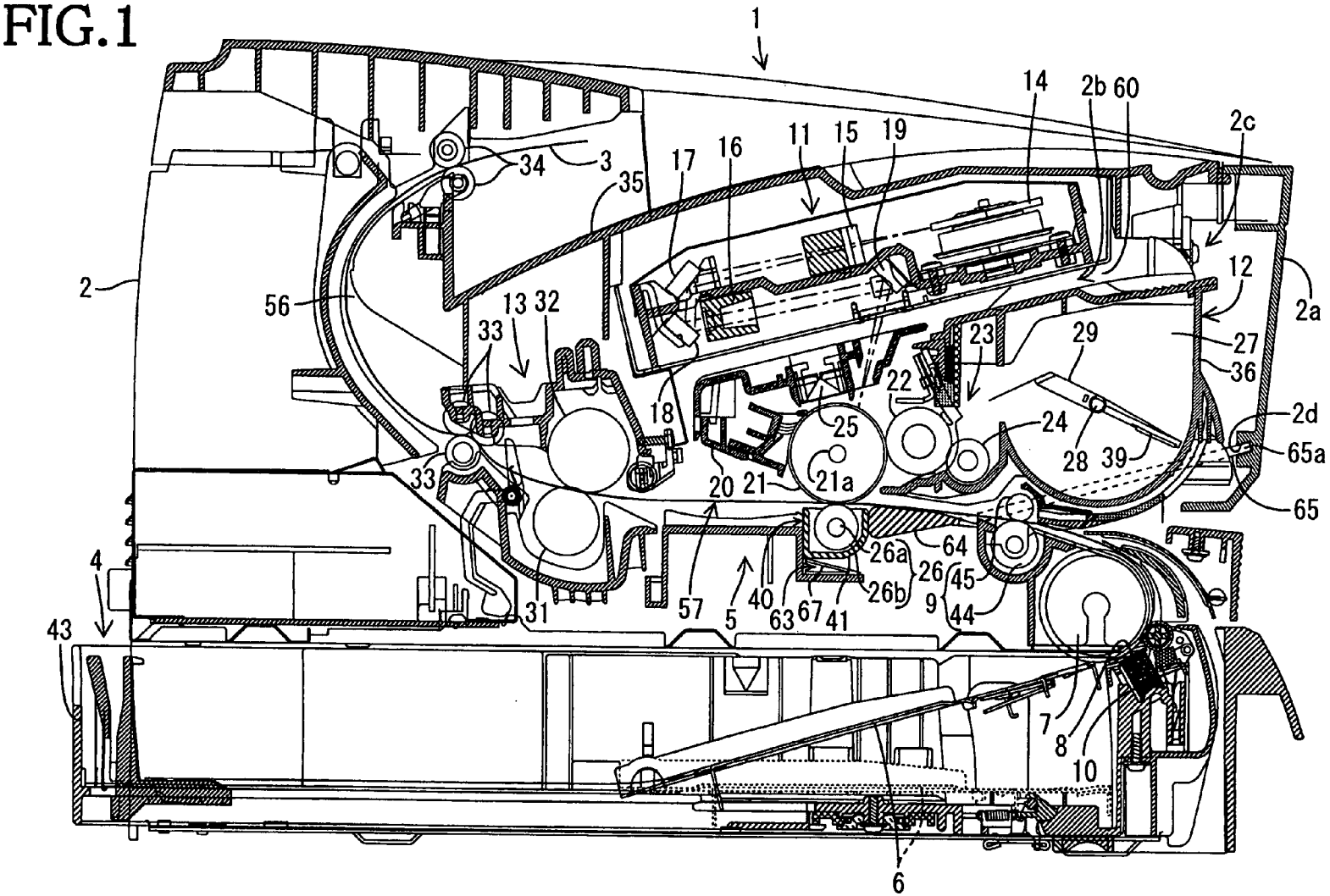
FIG. 1 is a cross sectional view of a general structure of laser printer according to an exemplary embodiment of the invention.

To help describe the features of the exemplary embodiments, the sides of a laser printer 1 are defined such that FIG. 1 illustrates a cross-sectional view of the laser printer 1 from a left side of the laser printer 1. Thus, the portion of the laser printer 1 illustrated on the right side of the sheet is the front side of the laser printer 1, the portion of the laser printer 1 illustrated on the left side of the sheet is referred to as the rear or back side of the laser printer 1, the portion of the laser printer 1 illustrated on the top or upper side of the sheet is referred to as the top or upper side of the laser printer 1, and the portion of the laser printer 1 illustrated on the bottom or lower side of the sheet is referred to as the bottom or lower side of the laser printer 1. Sides of components of the laser printer 1 are also referred to in view of the defined sides of the laser printer 1, and the sides of components that can be attached to/detached from the laser printer 1 are referred to in view of the arranged position of the attachable/detachable component in the laser printer 1. Further, the terms "left" and "right" will be used to refer to sides based a front view of the laser printer 1. These defined directions apply to all the drawings. Also, in the following description of exemplary embodiments, the term "substantially" is intended to include the terms "exactly" and "about".

As shown in FIG. 1, the laser printer 1, as an image forming apparatus, includes a body casing 2, a sheet feeding portion 4 that feeds a sheet 3, as a recording medium, and an image forming portion 5 that forms an image on the fed sheet 3. The sheet feeding portion 4 and the image forming portion 5 are provided in the body casing 2.

Figure 3:
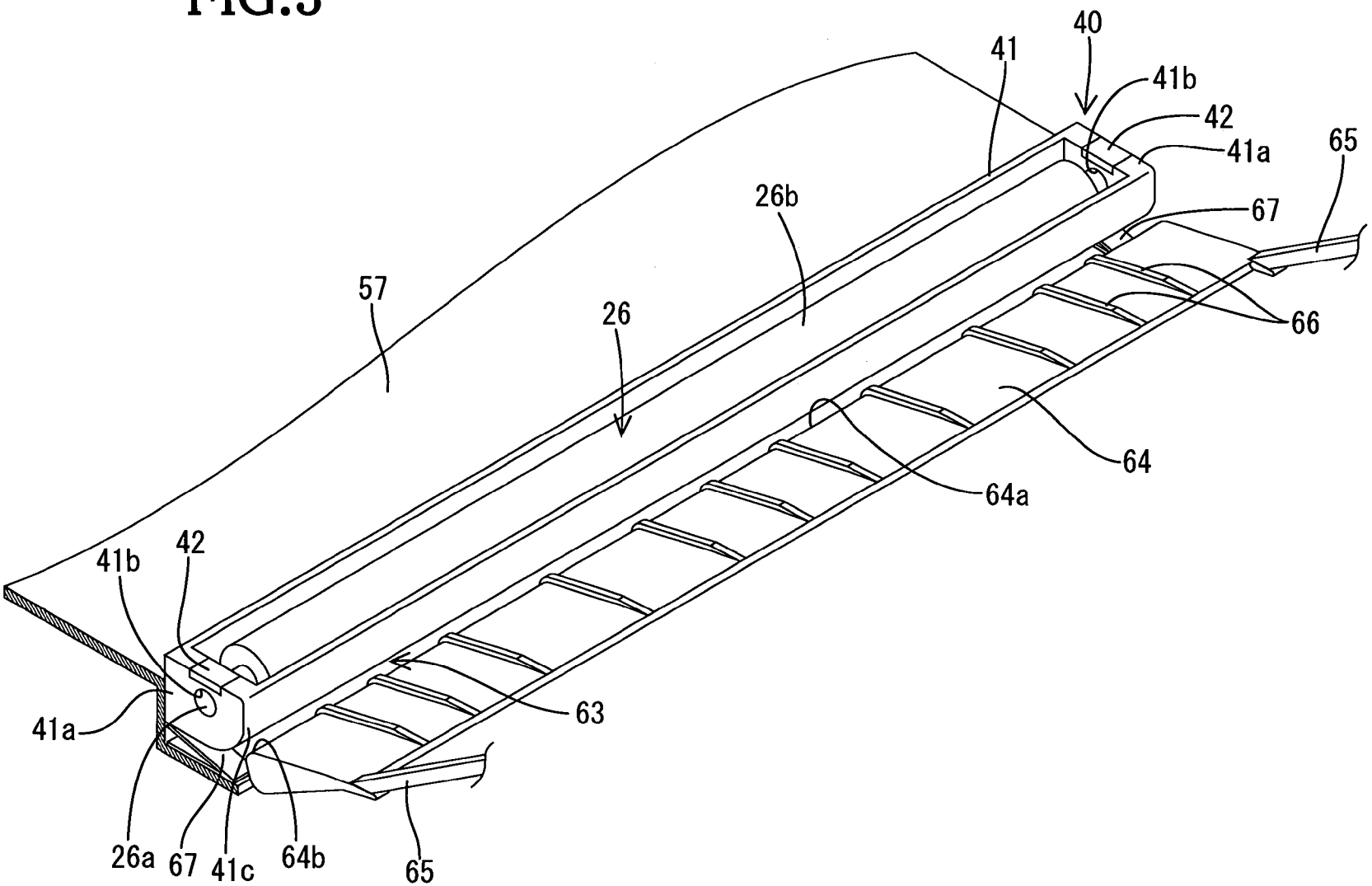
FIG. 3 is a perspective view of an exemplary transfer roller unit being accommodated in an exemplary accommodating portion and an exemplary guiding/restricting member of the laser printer illustrated in FIG. 1, with the guiding/restricting member in a released position.
Figure 4:
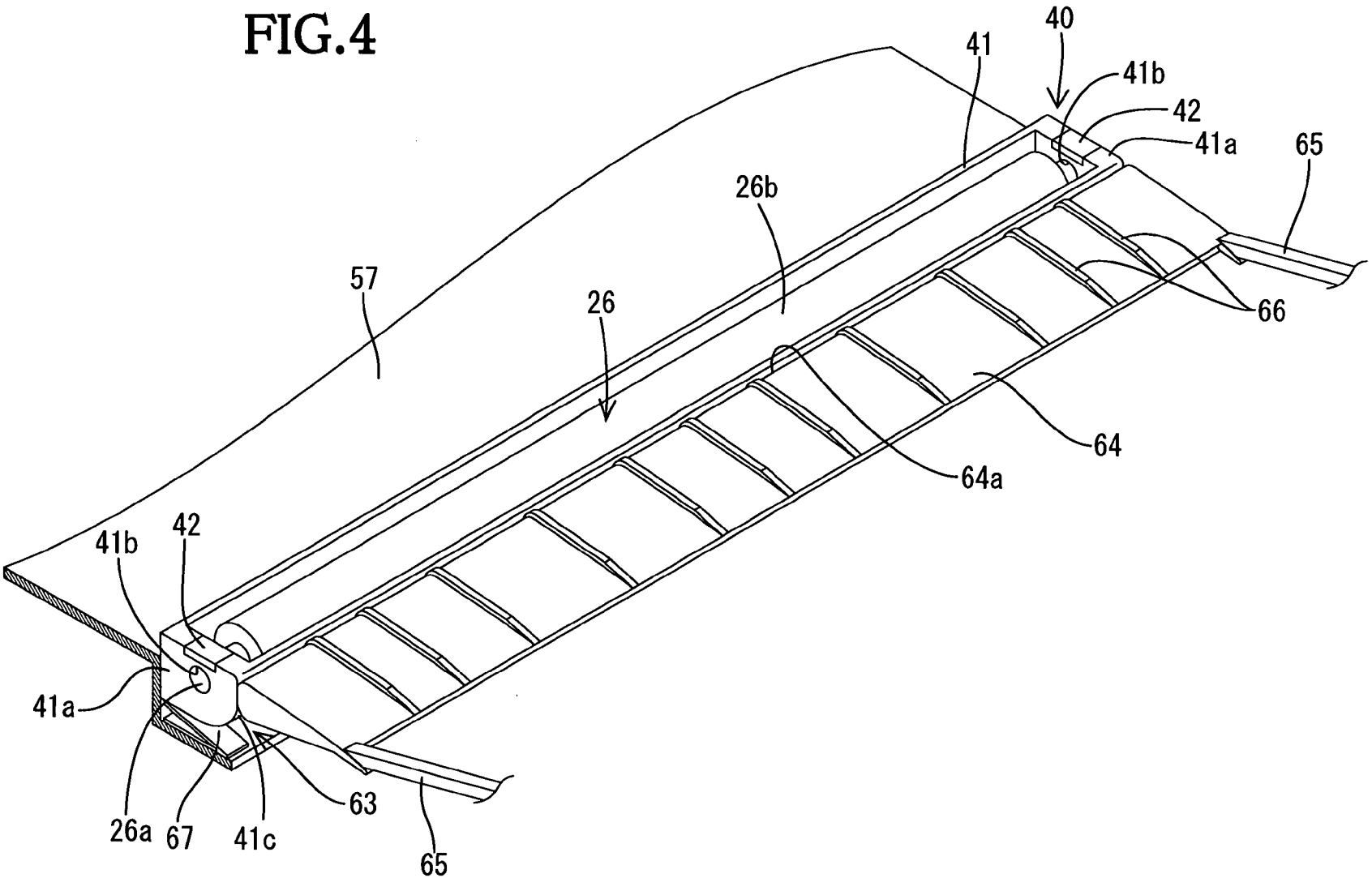
FIG. 4 is a perspective view of the transfer roller unit being accommodated in the accommodating portion, as illustrated in FIG. 3, with the guiding/restricting member in a restricted position.
Figure 5:
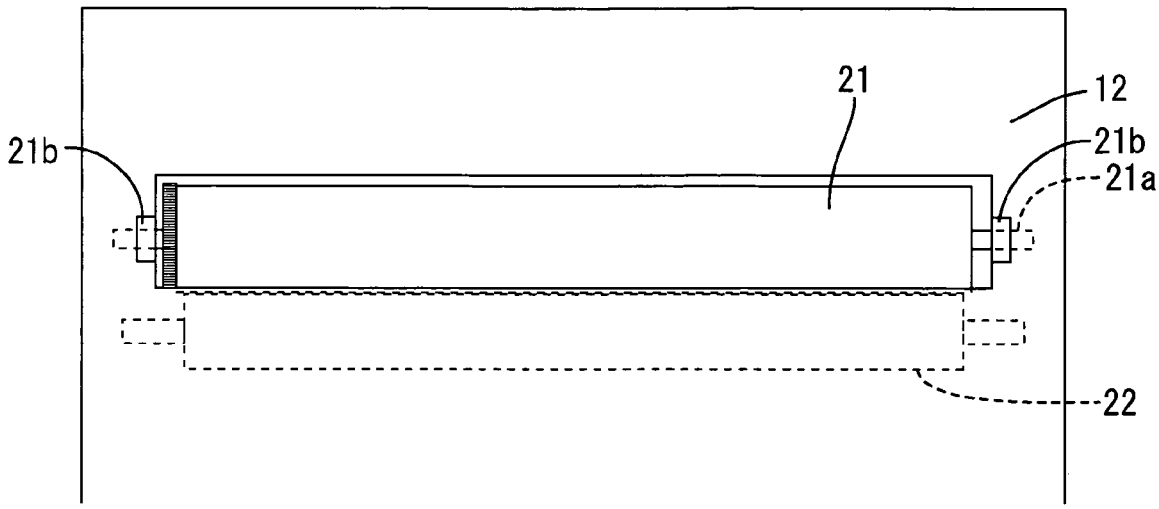
FIG. 5 is a schematic diagram of a bottom of the process cartridge illustrated in FIG. 2.
Figure 6:
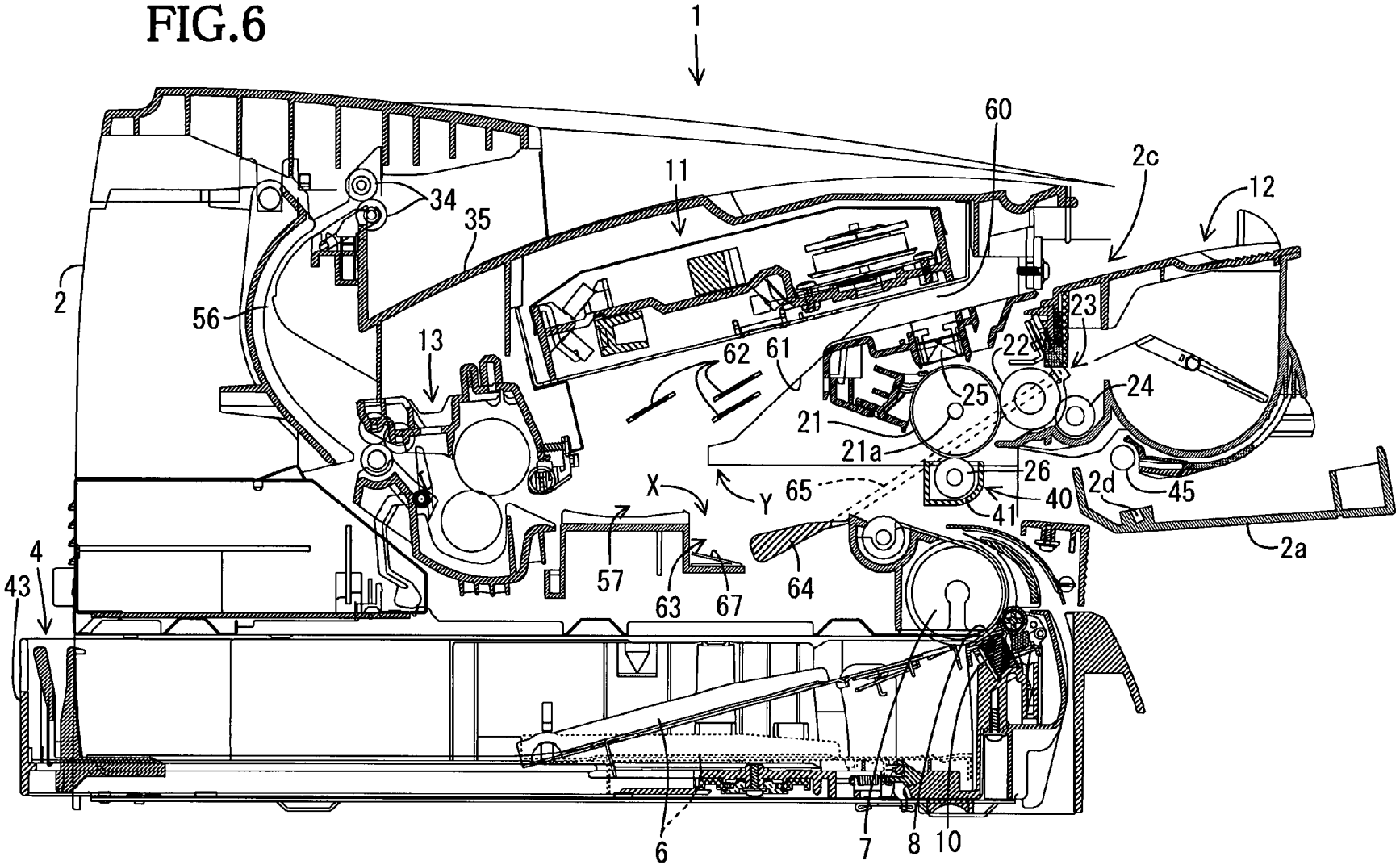
FIG. 6 is a cross sectional view showing the general structure of the laser printer illustrated in FIG. 1, with the guiding/restricting member in the released position.

In the exemplary embodiment of one or more aspects of the invention illustrated in FIGS. 1–7, an attachable/detachable process cartridge 12 and an attachable/detachable transfer roller unit 40 are provided as separate units such that each of the process cartridge 12 and the transfer roller unit 40 may be independently replaced. The attachable/detachable process cartridge 12 and the attachable/detachable transfer roller unit 40 may each be attached to and detached from the laser printer 1 and each other. The transfer roller unit 40 includes a transfer roller 26. A door 2*a* is provided, for example, on the front side (at a right side in FIG. 1) of the body casing 2 and the door 2*a* is rotatable about its lower end (FIGS. 1, 5 and 6). In the body casing 2, a passage 2*b* is provided. The transfer roller unit 40 and the process cartridge 12 pass through the passage 2*b* in order to be arranged in and removed from a transfer position X and an image forming position Y, respectively. An opening 2*c*, as an open end of the passage 2*b*, can be seen when the door 2 is in an open state.

The sheet feeding portion 4 includes a sheet supply tray 43, which is detachably attached to the bottom of the body casing 2, a sheet pressing member 6, which is provided in the sheet supply tray 43, a pick-up roller 7 and a separating pad 8, which are disposed above a front end of the sheet supply tray 43, and a pair of resist rollers 9, which is provided downstream of the pick-up roller 7 in a sheet conveying direction.

Sheets 3 can be stacked on the sheet pressing member 6. An end of the sheet pressing member 6 that is closer to the pick-up roller 7 is attached, for example, via a hinge, to a bottom of the sheet supply tray 43. The other end of the sheet pressing member 6 moves up and down, based on the amount of sheets 3 stacked thereon and/or whether the sheet supply tray 43 is attached to the laser printer 1. The sheet pressing member 6 is urged upward by a spring (not shown) arranged underneath the sheet pressing member 6. The end of the sheet pressing member 6 that is closer to the pick-up roller 7 moves upward, with the urging force of the spring as sheets 3 are removed from the stack, and downward, against the urging force of the spring, based on the amount of sheets 3 stacked thereon. A top-most sheet 3 of the stack is pressed against the pick-up roller 7 when the sheet supply tray 43 is arranged in the image forming apparatus. The pick-up roller 7 and the separating pad 8 are opposite to each other. The separating pad 8 is pressed toward the pick-up roller 7 by a spring 10, which is disposed below the separating pad 8.

As discussed above, the top-most sheet 3 in the stack placed in the sheet supply tray 6 is pressed against the pick-up roller 7 by, for example, the urging force of the spring (not shown) disposed at the underside of the sheet pressing member 6. One by one, the top-most sheet 3 is pinched and separated by the pick-up roller 7 and the separating pad 8, and supplied from the stack by rotation of the pick-up roller 7. The fed sheet 3 is conveyed to the pair of resist rollers 9 by rotation of the pick-up roller 7. The pair of resist rollers 9 includes a drive roller 44 that is provided on the body casing 2 and a following roller 45 that is provided on the process cartridge 12. The drive roller 44 and the following roller 45 pinch the sheet 3 fed from the pick-up roller 7 between them, and further convey the sheet 3 to the image forming portion 5 after correcting diagonal feeding of the sheet 3.

The image forming portion 5 includes a scanning unit 11, the process cartridge 12, the transfer roller unit 40, and a fixing unit 13.

The scanning unit 11 is arranged at an upper portion of the body casing 2 and includes a laser emitting portion (not shown), a rotatable polygon mirror 14, lenses 15, 16 and reflectors 17, 18, 19. A laser beam (dashed line in FIG. 1), which is emitted from the laser emitting portion based on image data, passes through or is reflected off the polygon mirror 14, the lens 15, the reflector 17, the reflector 18, the lens 16, and the reflector 19, in this order, before irradiating a surface of a photosensitive drum 21 of the process cartridge 12 during a high speed scanning process.

Figure 2:
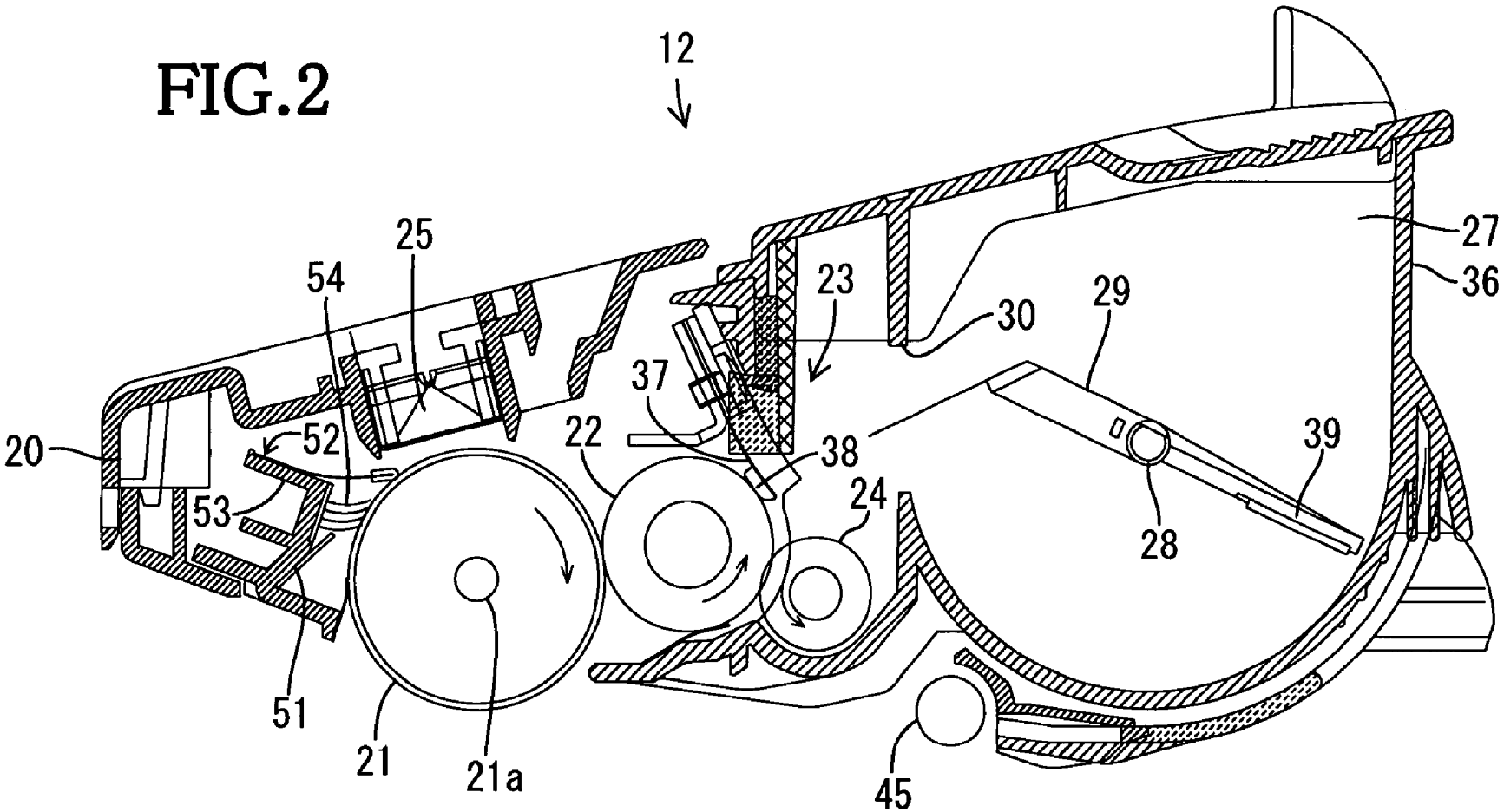
FIG. 2 is an enlarged cross sectional view of an exemplary process cartridge that may be employed by the laser printer illustrated in FIG. 1.

Next, the exemplary process cartridge 12 will be described with reference to FIG. 2. As shown in FIG. 2, the process cartridge 12 does not include the transfer roller 26. The transfer roller 26 is provided in the transfer roller unit 40. As discussed above, the transfer roller unit 40 can be detachably attached to the process cartridge 12. Thus, if the transfer roller 26 needs to be replaced, it is not necessary to replace both the transfer roller 26 and the process cartridge 12. Similarly, if only the process cartridge 12 needs to be replaced, it is not necessary to replace both the transfer roller 26 and the process cartridge 12. For attaching the transfer roller 26 to the laser printer 1, the transfer roller unit 40, including the transfer roller 26, is attached to the process cartridge 12 and then, arranged in the laser printer 1.

When the transfer roller unit 40 is arranged in the laser printer 1, as described in more detail below, and only the process cartridge 12 is to be removed, the transfer roller unit 40 may be disconnected or restricted from moving relative to the process cartridge 12 such that only the process cartridge 12 is removed from the laser printer 1. However, if both the transfer roller unit 40 and the process cartridge 12 are to be removed, the transfer roller unit 40 engages with the process cartridge 12 such that the transfer roller unit 40 and the process cartridge 12 are both removed from the laser printer 1. Thus, the transfer roller unit 40 has somewhat of a parasitic relationship with the process cartridge 12. The transfer roller unit 40 uses the process cartridge 12 as a means into and out of the passage 2*b*, but when the transfer roller unit 40 is arranged in the transfer position X or is outside of the laser printer 1, the transfer roller unit 40 may be detached from and handled independently from the process cartridge 12. Accordingly, in various embodiments of the invention, it is possible to replace only the transfer roller 26, only the process cartridge 12, or both the transfer roller 26 and the process cartridge 12, while reducing the amount of handling necessary to attach and detach the transfer roller 26 to and from the laser printer 1.

As shown in FIG. 1, when the attachable/detachable process cartridge 12 is arranged in the laser printer 1, the process cartridge 12 is situated below the scanning unit 11. As shown in FIG. 2, the process cartridge 12 includes the photosensitive drum 21, a developer cartridge 36, a scorotron charging device 25, and a drum cartridge 20. The scorotron charging device 25 is attached to a top rear portion of the drum cartridge 20 above the photosensitive drum 21. The drum cartridge 20 can be detachably attached to the body casing 2. The developer cartridge 36 can be attached to and detached from the drum cartridge 20 and includes a developing roller 22, a layer thickness regulating member 23, a toner supply roller 24, and a toner housing 27.

The toner housing 27 stores, for example, positively charged non-magnetic single-component toner, as a developing agent. The toner is, for example, a polymerized toner obtained through co-polymerization of styrene-based monomers, such as styrene, and acryl-based monomers, such as acrylic acid, alkyl (C1–C4) acrylate, alkyl (C1–C4) methacrylate, using a known polymerization method, such as suspension polymerization. The polymerized toner has a substantially spherical shape, has excellent fluidity, and allows for high quality images to be formed. A coloring agent, such as carbon black, and wax may be added to the polymerized toner. An external additive, such as silica, may also be added to the polymerized toner to improve the fluidity of the toner. In exemplary embodiments, the particle size of the polymerized toner is approximately 6–10 μm.

In addition to the toner, an agitator 29 is provided in the toner housing 27. The agitator 29 is supported by a rotating shaft 28 that is provided at a center of the toner housing 27. The toner stored in the toner housing 27 is agitated by the agitator 29 and is discharged from a toner supply port 30 provided at a side portion of the toner housing 27. A toner amount detecting window (not shown) is provided on a side wall of the toner housing 27. The toner amount detecting window is cleaned by a cleaner 39 supported by the rotating shaft 28.

The toner supply roller 24 is provided at a side of the toner supply port 30 and is rotatable in a direction indicated by an arrow in FIG. 2 (in a counterclockwise direction). The developing roller 22 is provided next to the toner supply roller 24 and is rotatable in a direction indicated by an arrow in FIG. 2 (in the counterclockwise direction). The toner supply roller 24 and the developing roller 22 press against each other such that toner being carried on the surface of the toner supply roller 24 can be transferred to the surface of the developing roller 22.

The toner supply roller 24 may include a roller shaft made of, for example, metal and covered with a roller portion made of, for example, a conductive foam material. The developing roller 22 may include a roller shaft made of, for example, metal and covered with a roller portion made, for example, of a conductive rubber material. The roller portion of the developing roller 22 may be made, for example, of conductive urethane rubber or conductive silicone rubber containing carbon particles and a surface of the roller portion of the developing roller 22 may be covered with a coating layer made, for example, of urethane rubber or silicone rubber containing fluorine. A predetermined developing bias may be applied to the developing roller 22.

The layer thickness regulating member 23 is disposed near the developing roller 22. The layer thickness regulating member 23 regulates a thickness of the toner transferred onto the surface of the developing roller 22 by the toner supply roller 24. The layer thickness regulating member 23 includes, for example, a flexible member 37 made, for example, of a flexible metal, and a pressing portion 38 made of, for example, an insulative silicone rubber. The pressing portion 38 has, for example, a semi-circular shape in cross section and is provided at a free end (a tip) of the flexible member 37. A base end of the flexible member 37 (i.e., end opposite to the end provided with the pressing portion 38) is supported by the developer cartridge 36 at a position near the developing roller 22 such that the pressing portion 38 can contact the surface of the developing roller 22. The pressing portion 38 of the flexible member 37 press-contacts the developing roller 22 by an elastic force of the flexible member 37.

The toner discharged from the toner supply port 30 is then supplied to the developing roller 22 by the rotation of the toner supply roller 24. At that time, the toner is positively charged by the friction between the contacting surfaces of the toner supply roller 24 and the developing roller 22. The toner supplied onto the developing roller 22 is sandwiched between the pressing portion 38 of the layer thickness regulating member 23 and the developing roller 22 by the rotation of the developing roller 22. The toner is further charged by the friction between the pressing portion 38 and the developing roller 22, and the toner becomes a thin layer, of uniform thickness, on the developing roller 22.

The photosensitive drum 21 is provided on a portion of the drum cartridge 20 such that when the developer cartridge 36 is attached to the drum cartridge 20, the photosensitive drum 21 can contact the developing roller 22. The photosensitive drum 21 is provided so as to be rotatable in a direction indicated by an arrow in FIG. 2 (in the clockwise direction). A drum body of the photosensitive drum 21 is connected to ground. An outer layer of the photosensitive drum 21 is a positively-charged photosensitive layer made of, for example, polycarbonate.

The scorotron charging device 25 is located above the photosensitive drum 21 such that a predetermined distance exists between the scorotron charging device 25 and the photosensitive drum 21. The scorotron charging device 25 is an electrifier that generates corona discharge from, for example, a tungsten charging wire in order to uniformly positively charge the surface of the photosensitive drum 21.

After the surface of the photosensitive drum 21 is uniformly positively charged by the scorotron charging device 25, as discussed above, the surface of the photosensitive drum 21 is exposed to the laser beam emitted from the scanning unit 11 by the high-speed scanning process and an electrostatic latent image, based on predetermined image data, is formed on the surface of the photosensitive drum 21. When the formed electrostatic latent image on the surface of the photosensitive drum 21 faces and contacts the developing roller 22, the positively charged toner held on the developing roller 22 is supplied to and held on portions of the surface of photosensitive drum 21 that correspond to the formed electrostatic latent image. That is, the portion of the surface of the photosensitive drum 21 that was exposed by the laser beam emitted by the scanning unit 11 and corresponds to the formed electrostatic latent image has a lower electric potential than the other portion (i.e., portion not exposed by the laser beam) of the photosensitive drum 21. Thus, the electrostatic latent image formed on the photosensitive drum 21 is visualized when the generally positively charged toner adheres to the lower potential portion of the surface of the photosensitive drum 21. Development of the electrostatic image is thereby accomplished (a toner image is formed on the surface of the photosensitive drum 21).

Brush support plates 51 are integrally provided on the lower front end of the drum cartridge 20 and, as illustrated in FIG. 2, the brush support plates 51 extend diagonally upward. A cleaning brush unit 52 is provided to the brush support plates 51. The cleaning brush unit 52 includes a brush holder 53 and a brush 54. The brush holder 53 is disposed so as to extend between the brush support plates 51. The brush 54 is provided on the brush holder 53 so as to be in contact with a surface of the photosensitive drum 21. The brush 54 is made of a conductive member. A bias voltage is applied to the brush 54 by a high-voltage power supply circuit (not shown) provided in the body casing 2, in order to remove paper dust from the photosensitive drum 21.

The transfer roller unit 40 will be described below. As shown in FIGS. 1, 3 and 4, the transfer roller unit 40 includes the transfer roller 26 and a holder 41, which holds a roller shaft 26*a* (as a rotating shaft member) of the transfer roller 26. The transfer roller 26 includes the roller shaft 26*a* made of, for example, metal and covered with a roller portion 26*b* made of, for example, a conductive rubber material. Both end portions of the roller shaft 26*a* are exposed.

The holder 41 has a long and narrow box-like shape with an open upper portion. As shown in FIG. 3, the holder 41 accommodates the transfer roller 26. When the transfer roller 26 is accommodated therein, an upper portion of the roller portion 26*b* of the transfer roller 26 is exposed. The holder 41 includes side walls 41*a*. Each of the side walls 41*a* has a shaft receiving hole 41*b*, into which the end portions of the roller shaft 26*a* of the transfer roller 26 are inserted and by which the end portions of the roller shaft 26*a* of the transfer roller 26 are rotatably supported such that the transfer roller 26 is rotatable with respect to the holder 41. The holder 41 has a rounded or curved surface 41*c* that has an arc-like shape in cross section and extends between the sidewalls 41*a*. The curved surface 41*c* faces a guiding/restricting member 64, discussed below.

A predetermined transfer bias, with respect to the photosensitive drum 21, is applied to the transfer roller 26 of the transfer roller unit 40, when the transfer roller unit 40 is arranged at the transfer position X (FIG. 6) in order to transfer the toner image being carried on the photosensitive drum 21 to the sheet 3. The visualized developed electrostatic image that is held on the surface of the photosensitive drum 21 is transferred onto the sheet 3 while the sheet 3 passes between the photosensitive drum 21 and the transfer roller 26.

As shown in FIG. 1, the fixing unit 13 is provided downstream of the process cartridge 12 in the sheet conveying direction. The fixing unit 13 includes a heat roller 32, a pressing roller 31, which is pressed against the heat roller 32, and conveyor rollers 33, which are disposed downstream of the heat roller 32 and the pressing roller 31 in the sheet conveying direction. The heat roller 32 includes a base tube made of, for example, metal, and a halogen lamp inside the base tube. The halogen lamp generates heat. At the fixing unit 13, the toner transferred onto the sheet 3 is thermally fixed onto the sheet 3 while the sheet 3 passes between the heat roller 32 and the pressing roller 31. The sheet 3 on which the toner is fixed is further conveyed to a sheet discharge path 56 by the conveyor rollers 33. The sheet 3 conveyed to the sheet discharge path 56 is then discharged onto a sheet discharge tray 35 by a pair of sheet discharge rollers 34.

The laser printer 1 employs a so called "cleaner-less" cleaning method to collect toner remaining on the surface of the photosensitive drum 21. The "cleaner-less" cleaning method uses the developing roller 22 to collect the remaining toner after an image is transferred onto a sheet 3 by the transfer roller 26. Because toner that remains on the surface of the photosensitive drum 21 is collected by the "cleanerless" cleaning method, it is not necessary to provide a device for cleaning a blade or a waste toner storage device, thereby simplifying the structure of the laser printer 1 and further enabling the downsizing of the laser printer 1, and reducing the manufacturing cost of the laser printer 1.

Figure 7:
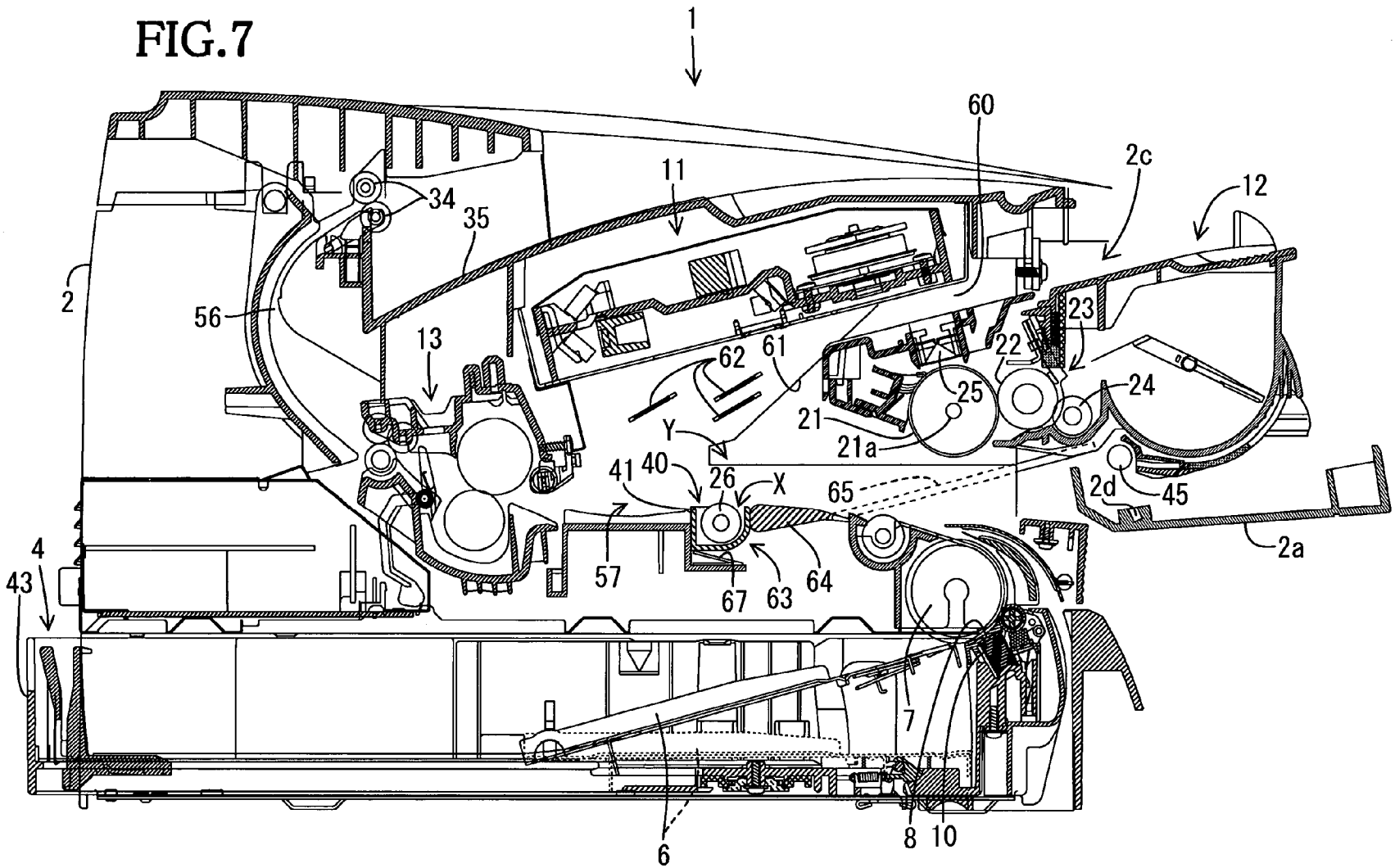
FIG. 7 is a cross sectional view showing the general structure of the laser printer illustrated in FIG. 1, with the guiding/restricting member in the restricted position.

As shown in FIGS. 1, 6, and 7, when the door 2*a* of the body casing 2 is open, a conveying path 57 through which a sheet 3 passes, after being conveyed from the sheet feeding portion 4, is exposed below and at the back of the passage 2*b*. Hereinafter, a direction from the door 2*a* to the back side of the passage 2*b* (a direction from the right to the left in FIGS. 1, 6, and 7) is referred to as an insertion direction and a direction opposite to the insertion direction is referred to as a removing direction.

The process cartridge 12 is inserted from the opening 2*c* and arranged in the image forming position Y (FIG. 6). An axial direction (i.e., direction of the axis about which the photosensitive drum 21 rotates) of the photosensitive drum 21 extends in a direction that is substantially perpendicular to the insertion direction. The image forming position Y refers to a position where the process cartridge 12, and in particular the photosensitive drum 21, is arranged such that the photosensitive drum 21 can appropriately contact the transfer roller 26 when the transfer roller unit 40, and in particular the transfer roller 26 is arranged in the transfer position X. The transfer position X refers to a position where the transfer roller unit 40, and in particular, the transfer roller 26, is arranged such that the transfer roller 26 can appropriately contact the photosensitive drum 21, when the process cartridge 12, and in particular the photosensitive drum 21, is in the image forming position Y. When the photosensitive drum 21 is at the image forming position Y and the transfer roller 26 is at the transfer position X, the conveying path 57 is sandwiched between the photosensitive drum 21 and the transfer roller 26, from above and below.

The transfer roller unit 40 is inserted from the opening 2*c* and is arranged in the transfer position X while an axial direction (i.e., direction of the axis about which the transfer roller 26 rotates) of the transfer roller 26 extends in a direction that is substantially perpendicular to the insertion direction. As discussed above, when the transfer roller 26 is at the transfer position X, the transfer roller 26 contacts the photosensitive drum 21 when the photosensitive drum 21 is arranged in the image forming position Y such that the conveying path 57 is sandwiched between the photosensitive drum 21 and the transfer roller 26, from above and below.

The body casing 2 includes a pair of opposing walls 60 (only a right wall 60 is indicated) on both sides of the passage 2*b* in the width direction (in a depth direction on the drawing sheet of FIGS. 1, 6, and 7). Each of the walls 60 has a guide groove 61 that is recessed toward the outside in the width direction. The guide groove 61 extends from the opening 2*c* toward the back of the laser printer 1 and the guide groove 61 narrows as it approaches the back of the laser printer 1. When the process cartridge 12 is inserted into the opening 2*c*, the process cartridge 12 is guided through the passage 2*b* and into the Y position (i.e., position where photosensitive drum 21 can contact transfer roller 26, when the transfer roller unit 40 is in the X position) by the end portions of a roller shaft 21*a* of the photosensitive drum 21, which outwardly protrude from both sides of the photosensitive drum 21 and are guided by the respective guide grooves 61. Thus, the process cartridge 12 is positioned and held at the image forming position Y.

At an inner end portion of the guide groove 61 (i.e., end of guide groove 61 that is farther from the door 2*a*) of the right wall 60 of the passage 2*b*, three exposed electrodes 62 are provided. The exposed electrodes 62 are connected to a high-voltage source (not shown) provided on the body casing 2, and each electrode 62 is arranged along the passage 2*b* such that when the process cartridge 12 is arranged in the Y position, each of the exposed electrodes 62 contacts a corresponding exposed electrode (not shown) projecting from the right side of the process cartridge 12. When the process cartridge 12 is arranged in the Y position, one of these electrodes 62 connects to an electrode that is connected to the cleaning brush unit 52, the second of these electrodes 62 connects to a grid electrode of the scorotron charging device 25, and the third of these electrodes 62 connects to the charging wire of the scorotron charging device 25, in order to apply the bias voltage to the respective electrode.

As discussed above, when the transfer roller 26 is at the transfer position X, the transfer roller 26 contacts the photosensitive drum 21 when the photosensitive drum 21 is arranged at the image forming position Y such that the conveying path 57 is sandwiched between the photosensitive drum 21 and the transfer roller 26, from above and below. Thus, as shown for example, in FIG. 7, the transfer position X is a position below the conveying path 57 of the sheet 3. An accommodating portion 63 is provided in the laser printer 1 and the accommodating portion 63 extends across the conveying path 57 (i.e., between the left and right sides of the laser printer 1). When the transfer roller unit 40 is arranged in the laser printer 1, the transfer roller unit 40 is accommodated in the accommodating portion 63, and when the transfer roller unit 40 is arranged in the accommodating portion 63, the transfer roller 26 is in the transfer position X.

The accommodating portion 63 may have, for example, a substantially vertically oriented supporting member or wall, a substantially horizontally oriented supporting member or wall, and pressing members 67 arranged on the left and right sides of a top surface of the substantially horizontally oriented supporting member. A bottom end of the substantially vertically oriented supporting member may be connected to a back end of the substantially horizontally oriented supporting member to define a space within the laser printer 1 for accommodating the transfer roller unit 40.

The pressing members (e.g., flexible plate-like springs) 67, as an urging device, are provided, for example, on the top surface of the substantially horizontally oriented supporting member of the accommodating portion 63 at positions corresponding to the respective end portions (i.e., left and right sides) of the transfer roller unit 40 that is arranged in the transfer position X. Each pressing member 67 is made of, for example, a rectangular metal member that is bent at a substantially middle portion thereof so as to form a V-like shape. Each pressing member 67 is fixed to the bottom surface of the accommodating portion 63 so that the transfer roller 26, which is arranged in the transfer roller unit 40 that is accommodated by the accommodating portion 63, is urged upward by the pressing member 67. The transfer roller 26 is urged upward to ensure that the transfer roller 26, arranged at the X position, is in contact with the photosensitive drum that is arranged at the Y position, above the transfer roller 26 at the X position. The pressing members 67 are arranged such that the open ends of the V face the back of the laser printer 1 and away from the guiding/restricting member 64.

As illustrated in FIG. 4, the guiding/restricting member 64 has a generally rectangular-like shape, when viewed from above, and as illustrated in FIG. 6, the guiding/restricting member 64 is provided downstream of the pair of resist rollers 9 and upstream of the accommodating portion 63, with respect to the insertion direction. The guiding/restricting member 64 is movable or swingable such that the guiding/restricting member 64 can move between a substantially horizontal position (i.e., a restricted position) and an inclined position (i.e., a released position) where an upstream end of the guiding/restricting member 64 (i.e., the end of the guiding/restricting member 64 that extends across the conveying path 57 between the left and right sidewalls of the laser printer 1 and is closer to the pair of resist rollers 9) is at a higher level than a downstream end 64*a* of the guiding/restricting member 64 (i.e., the end of the guiding/restricting member 64 that extends across the conveying path 57 between the left and right sidewalls of the laser printer 1 and is closer to the accommodating portion 63).

In the released position, the guiding/restricting member 64 declines downward such that the downstream end 64*a* of the guiding/restricting member 64 is directed toward the bottom of the accommodating portion 63, as shown in FIG. 3. In the restricted position, as shown in FIG. 4, the downstream end 64*a* is raised, such that an upper surface of the guiding/restricting member 64 is substantially aligned with a top portion of the transfer roller unit 40 so as to define a portion of the sheet conveying path above the guiding/restricting member 64 and the transfer roller unit 40. As shown in FIG. 1, when the guiding/restricting member 64 is in the restricted position, the guiding/restricting member 64 defines the bottom of the conveying path 57 between the pair of resist rollers 9 and the transfer roller unit 40.

With this structure, when the guiding/restricting member 64 is in the restricted position, the transfer roller unit 40 is fixedly positioned and engaged between the downstream end 64*a* of the guiding/restricting member 64 and the vertically oriented supporting member of the accommodating portion 63, at its upstream and downstream ends, respectively, with respect to the insertion direction. When the guiding/restricting member 64 is in the released position, the guiding/restricting member 64 does not press against the upstream side of the transfer roller unit 40 and, as discussed above, is positioned such that the downstream end 64*a* of the guiding/restricting member 64 is close to the upstream end of the substantially horizontally oriented supporting member of the accommodating portion 63 such that the transfer roller unit 40 can be removed from the laser printer 1. When the transfer roller unit 40 is being removed from the laser printer 1, the transfer roller unit 40 moves above an upper surface of the guiding/restricting member 64 towards the opening 2*c*.

As illustrated in FIGS. 3 and 4, a plurality of ribs 66 may be provided on the upper surface of the guiding/restricting member 64. The plurality of ribs 66, having a predetermined space between them, may be aligned so as to extend along the conveying path 57. When the guiding/restricting member 64 is in the restricted position, the plurality of ribs 66 extend along the conveying path 57 and function as a guiding portion that guides a sheet 3, from the pair of resist rollers 9 to a position between the photosensitive drum 21 and the transfer roller 26.

As discussed above, the holder 41 of the transfer roller unit 40 has the rounded or curved surface 41*c* at the surface opposite to the guiding/restricting member 64. As shown in FIG. 3, the downstream end 64*a* of the guiding/restricting member 64, with respect to the insertion direction, also has a rounded or curved surface 64*b*, that extends across the conveying path 57 between the left and right sidewalls of the laser printer 1. Therefore, in accordance with the position change of the guiding/restricting member 64 from the released position to the restricted position, the rounded or curved surface 41*c* of the holder 41 and the rounded or curved surface 64*b* of the guiding/restricting member 64 are slidingly contacted with each other, so that the transfer roller unit 40 is gradually pressed against, for example, the substantially vertically oriented supporting member of the accommodating portion 63. Thus, the transfer roller unit 40 can be smoothly positioned into the accommodating portion 63.

The guiding/restricting member 64 can be put into the restricted position and/or put into the released position using, for example, a pair of support arms 65. As illustrated in FIGS. 1, 6 and 7, the pair of support arms 65 protrudes from both sides of the upstream end of the guiding/restricting member 64, with respect to the insertion direction, so as to project from the sides of the opening 2*c* of the body casing 2. FIG. 1 shows the guiding/restricting member 64 and the position of the support arms 65 when the guiding/restricting member 64 is in the restricted position while FIG. 6 shows the guiding/restricting member 64 and the position of the support arms 65 when the guiding/restricting member 64 is in the released position. Thus, it can be seen that in the exemplary embodiment, when the support arms 65 are moved upward, the guiding/restricting member 64 is put into the released position (i.e., released from the restricted position), and when the support arms 65 are moved downward, the guiding/restricting member 64 is put into the restricted position. The support arms 65 can be moved (e.g., up and down) by moving projecting ends 65*a* of the support arms 65 (FIG. 1). Thus, in the exemplary embodiment, by moving (e.g., up and down) the projecting ends 65*a* of the support arms 65, the position of the guiding/restricting member 64 can be changed between the restricted position and the released position.

As shown in FIG. 1, when the guiding/restricting member 64 is in the restricted position, when the door 2*a* is closed, the projecting ends 65*a* of the support arms 65 engage with respective recesses 2*d*, which are provided in an inner surface of the door 2*a*. That is, when the door 2*a* is closed and the projecting ends 65*a* of the support arms 65 are engaged with the respective recesses 2*d*, the guiding/restricting member 64 is retained in the restricted position and the transfer roller unit 40 is guided into and maintained in the accommodating portion 63. When the guiding/restricting member 64 is in the restricted position, movement of the transfer roller unit 40 in the insertion and removing directions is restricted. As discussed above, the guiding/restricting member 64 can be put into the released position, by moving the projecting ends 65*a* of the support arms 65 upward. When the projecting ends 65*a* of the support arms 65 do not engage with the recesses 2*d* of the door 2*a*, the door 2*a* does not close properly. By not allowing the door 2*a* to close properly if the projecting ends 65*a* of the support arms 65 do not engage with the recesses 2*d* of the door 2*a*, a user is reminded to move the support arms 65 to bring the guiding/restricting member 64 into the restricted position.

As shown in FIGS. 3 and 4, the transfer roller unit 40 is provided with a metal plate 42 at an upper surface of each side wall 41*a* of the holder 41. As shown in FIG. 5, magnets 21*b* are provided on the process cartridge 12 at positions corresponding to the metal plates 42 of the transfer roller unit 40. With this structure, the transfer roller unit 40 can be connected to the lower surface of the process cartridge 12 by the magnetic force generated between the metal plates 42 and the magnets 21*b*. The metal plates 42 and the magnets 21*b* function as a pair of connecting members.

To remove or replace the transfer roller unit 40 due to, for example, the end of the life of the transfer roller 26 caused by deterioration of the transfer roller 26, first, the door 2*a* is opened and the projecting ends 65*a* of the support arms 65 are moved, for example, upward to put the guiding/restricting member 64 into the released position. As discussed above, when the guiding/restricting member 64 is in the released position, the guiding/restricting member 64 no longer presses against the transfer roller unit 40 and the transfer roller unit 40 can be moved. Therefore, when the guiding/restricting member 64 is in the released position, when the process cartridge 12 is pulled through the opening 2*c*, the transfer roller unit 40, which is, for example, magnetically attached to the bottom surface of the process cartridge 12, is integrally removed with the process cartridge 12. When the process cartridge 12 is removed from the body casing 2, the deteriorated transfer roller unit 40 can be detached from process cartridge 12 and, for example, the deteriorated transfer roller unit 40 can be replaced with a new transfer roller unit 40.

By attaching the new transfer roller unit 40 to the bottom surface of the process cartridge 12, when the process cartridge 12 is attached to the body casing 2, by inserting the process cartridge 12 through the opening 2*c* until the process cartridge 12 is in the image forming position Y, the new transfer roller unit 40 is accommodated by the accommodating portion 63. Then, when the support arms 65 are moved, for example, downward in order to engage the support arms 65 with the recesses 2*d* of the door 2*a*, when the door 2*a* is closed, the new transfer roller unit 40 is fixed to the accommodating portion 63 (FIG. 1), as discussed above, and the replacement of the transfer roller unit 40 is complete.

To replace the process cartridge 12 with a new one due to, for example, the end of the life of the process cartridge 12 caused by, for example, deterioration of the photosensitive drum 21 or the lack of toner in the developer cartridge 36, first, the door 2*a* is opened and the process cartridge 12 is pulled out while the support arms 65 are retained at the downward position (i.e., the guiding/restricting member 64 is retained in the restricted position). By maintaining the guiding/restricting member 64 in the restricted position, as discussed above, the transfer roller unit 40 is maintained at the fixed position between the guiding/restricting member 64 and the accommodating portion 63, so that the movement of the transfer roller unit 40 is restricted. Therefore, the connection (e.g., magnetic connection) between the transfer roller unit 40 and the process cartridge 12 is released, so that the process cartridge 12 can be removed while the transfer roller unit 40 is left in the accommodating portion 63. At that time, the guiding/restricting member 64 functions as a release device for releasing the process cartridge 12 from the transfer roller unit 40 when movement of the transfer roller unit 40 in the attaching and removing directions is restricted by the guiding/restricting member 64. Then, if, for example, the life of the photosensitive drum 21 has ended, the drum cartridge 20 can be replaced with a new one and/or if the toner has run out, the developer cartridge 36 can be replaced with a new one. The process cartridge 12 having the new drum cartridge 20 and/or the new developer cartridge 36 is then inserted into the body casing 2 through the opening 2*c* until the process cartridge 12 is arranged in the image forming position Y and replacement of the process cartridge 12 is complete.

According to the exemplary embodiment, for example, to remove the transfer roller unit 40 in order to, for example, replace the transfer roller unit 40 with a new transfer roller unit 40, the process cartridge 12, with the transfer roller unit 40 attached thereto, is detached from the body casing 2 through the opening 2*c* by moving the support arms 65 upward to put the guiding/restricting member 64 into the released position before pulling out the process cartridge 12. Then, a new transfer roller unit 40 can be connected to the process cartridge 12 in place of, for example, the deteriorated transfer roller unit 40. The process cartridge 12 with the new transfer roller unit 40 can then be arranged in the body casing 2 by inserting the process cartridge 12 into the body casing 2 through the opening 2*c* until the process cartridge 12 is arranged at the image forming position Y and the transfer roller unit is arranged in the transfer position X. By the above-described process and structure, the user can easily attach and remove the transfer roller unit 40 to and from the transfer position X without directly touching the transfer roller 26 by hand.

As discussed above, the process cartridge 12 and the transfer roller unit 40 are connected with each other by the magnets 21*b* provided on the process cartridge 12 and the metal plates 42 provided on the transfer roller unit 40. Therefore, the connecting device can be achieved by a relatively simple structure.

When only the process cartridge 12 is to be removed in order to, for example, replace the process cartridge 12, the drum cartridge 20 and/or the developer cartridge 36 with a new one, the support arms 65 are maintained or put in the downward position in order to keep or put the guiding/restricting member 64 in the restricted position, where movement of the transfer roller unit 40 in the attaching and removing directions is restricted, so that the process cartridge 12 can be removed from the body casing 2, without moving the transfer roller unit 40.

As discussed above, in the above-described exemplary embodiment, the transfer roller unit 40 need only be removed from the body casing 2 or moved from the transfer position X, when it desired or necessary to remove the transfer roller unit 40 from the body casing 2, and it is possible to remove the transfer roller unit 40 from the body casing 2 without touching the transfer roller 26. That is, it is not necessary to remove the transfer roller unit 40 when it is only necessary or desired to remove the process cartridge 12. If it is necessary, however, to remove both the transfer roller unit 40 and the process cartridge 12, both the transfer roller unit 40 and the process cartridge 12 can be removed simultaneously (i.e., by maintaining the connection between the process cartridge 12 and the transfer roller unit 40). Thus, the risk of damage to the surface of the transfer roller 26 caused by scratches or fingerprints can be minimized, and preferably prevented.

The upper surface of the guiding/restricting member 64, which helps guide the sheet 3, as discussed above, is provided with the ribs 66. Therefore, the sheet 3 can be guided between the photosensitive drum 21 and the transfer roller 26 when the guiding/restricting member 64 is in the restricted position.

The pressing members 67, which urge the transfer roller unit 40 upward, are provided on the accommodating portion 63 of the body casing 2. With this structure, the transfer roller 26 can be pressed against the photosensitive drum 21 while the transfer roller unit 40 and the process cartridge 12 are respectively attached to the body casing 2 at the transfer position X and the image forming position Y. Thus, image formation can be performed with excellent quality.

Next, an exemplary embodiment of the invention will be described below with reference to FIGS. 8–10. Only differences between the exemplary embodiment shown in FIGS. 1–7 and the exemplary embodiment shown in FIGS. 8–10 will be described below. The difference between the exemplary embodiment shown in FIGS. 8–10 and the exemplary embodiment shown in FIGS. 1–7 relate to the structure of the connecting device for connecting a process cartridge and a transfer roller unit. Parts of the exemplary embodiment illustrated in FIGS. 8–10 that are not mentioned below are the same as those of the exemplary embodiment illustrated in FIGS. 1–7. Thus, the same parts are designated with the same numerals and explanations for those parts are omitted below.

Figure 8:
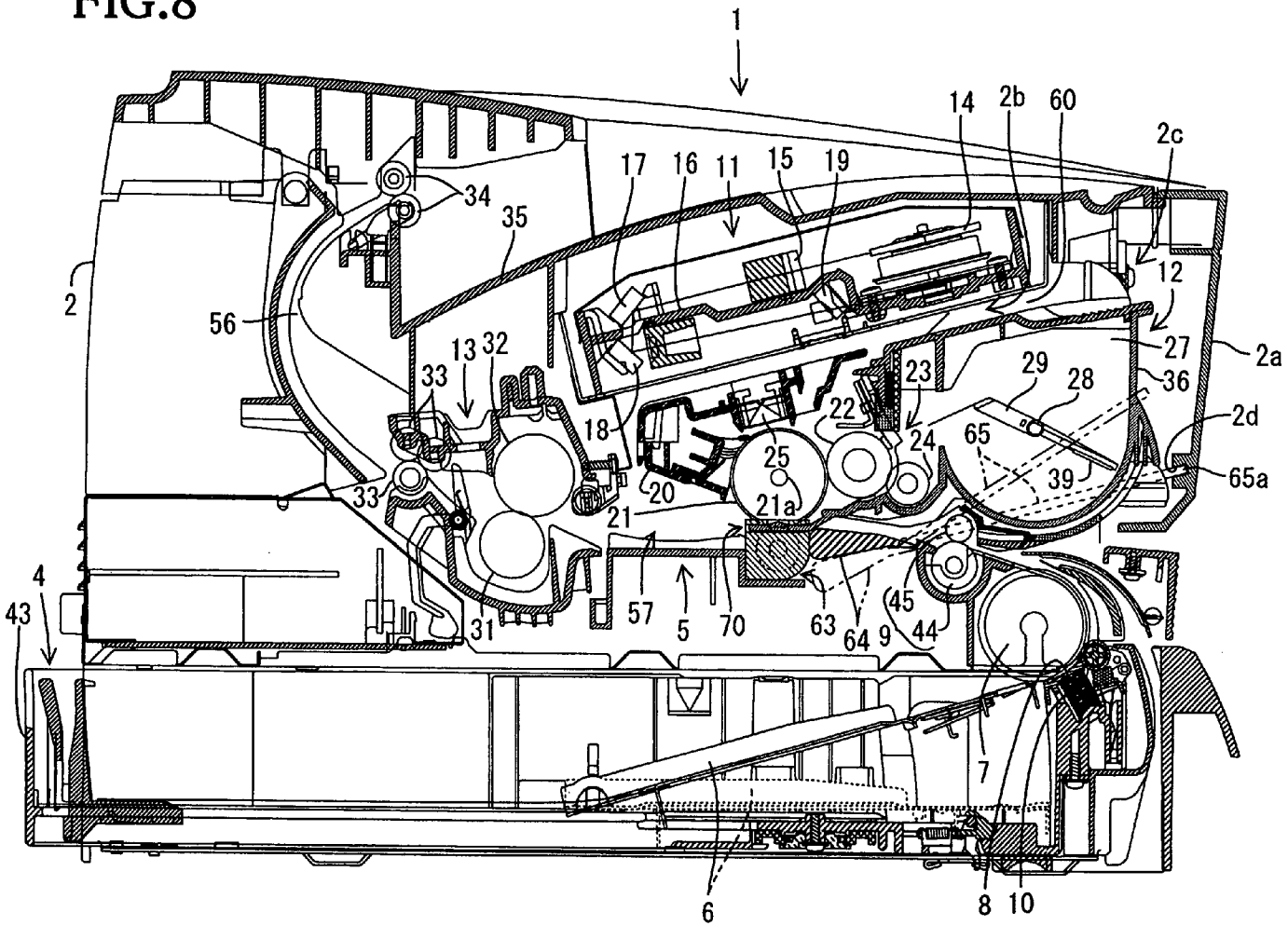
FIG. 8 is a cross sectional view of a general structure of a laser printer according to an exemplary embodiment of the invention.
Figure 9:
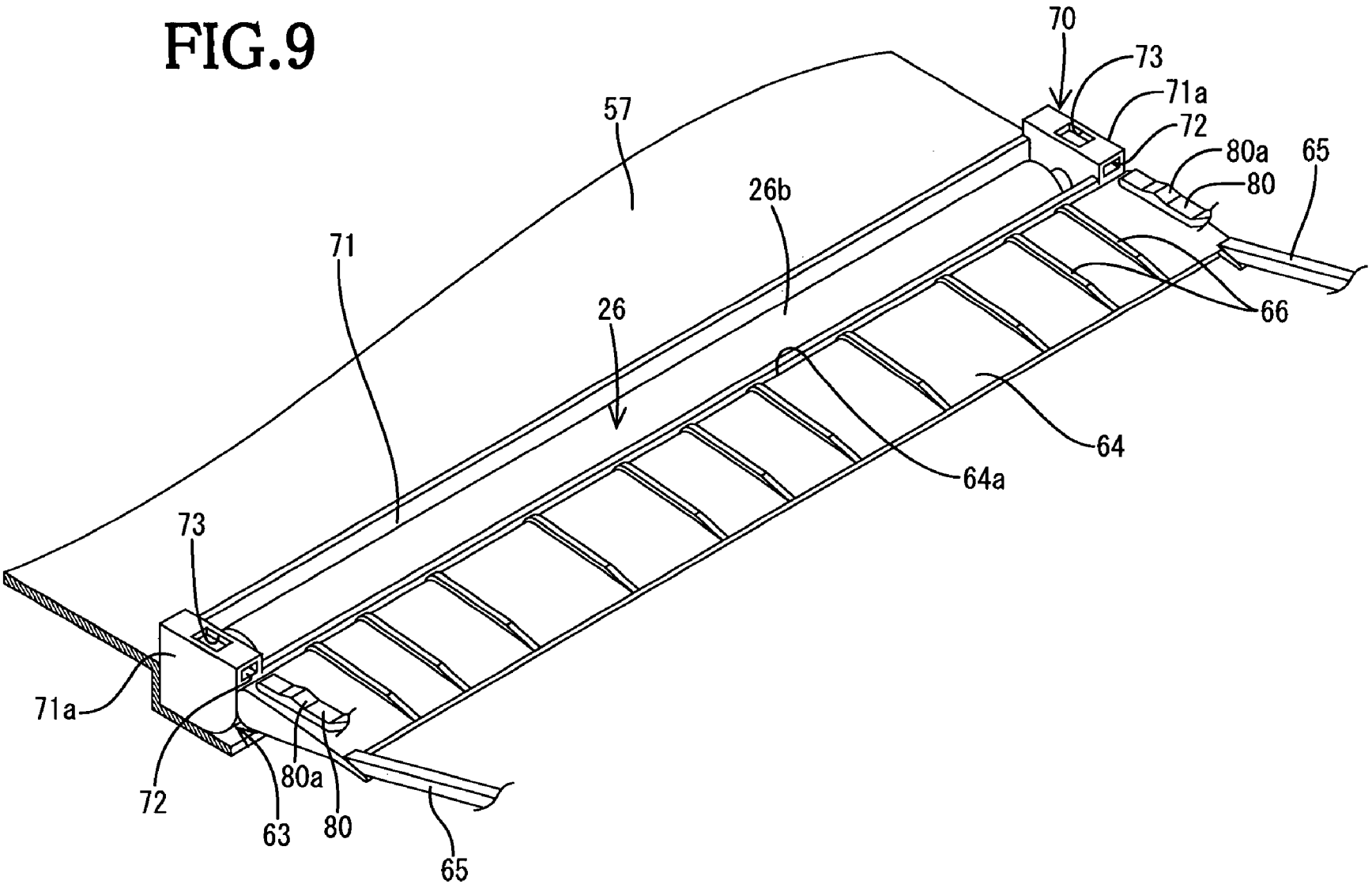
FIG. 9 is a perspective view of an exemplary transfer roller unit accommodated in an exemplary accommodating portion, and an exemplary guiding/restricting member of the laser printer illustrated in FIG. 8, with the guiding/restricting member in a restricted position.

As shown in FIGS. 8 and 9, a transfer roller unit 70 of the exemplary embodiment includes a transfer roller 26 and a holder 71 that rotatably supports the transfer roller 26. The holder 71 has substantially the same shape as the holder 41 of the exemplary embodiment shown in FIGS. 1–7. The holder 71 has insertion holes 72, which are open toward the front of the laser printer 1, on side wall portions 71*a* of the holder 71. Upper surfaces of the side wall portions 71*a* are provided with engagement holes 73, which communicate with the respective insertion holes 72.

A pair of engaging protrusions 80 are provided to both ends of the lower surface of the process cartridge 12 so as to protrude toward the front from the rear of the photosensitive drum 21. The engaging protrusions 80 can be inserted into the respective insertion holes 72 of the transfer roller unit 70. Each of the engaging protrusions 80 has a projecting portion 80*a* on an upper surface thereof. The projecting portion 80*a* has a height that is slightly higher than that of the insertion holes 72. The projecting portions 80*a* engage with the respective engagement holes 73 when the engaging protrusions 80 are inserted into the respective insertion holes 72 (FIG. 8). Accordingly, the transfer roller unit 70 can be connected to the process cartridge 12.

As discussed above with regard to the exemplary embodiment shown in FIGS. 1–7, when the guiding/restricting member 64 is in the restricted position, the transfer roller unit 70 is fixedly positioned in the accommodating portion 63, so that the process cartridge 12 can be independently removed from the body casing 2. When the guiding/restricting member 64 is in the released position, the fixing of the transfer roller unit 70 achieved by the guiding/restricting member 64 is released so that the transfer roller unit 70 can be removed from the body casing 2 together with the process cartridge 12.

Figure 10:
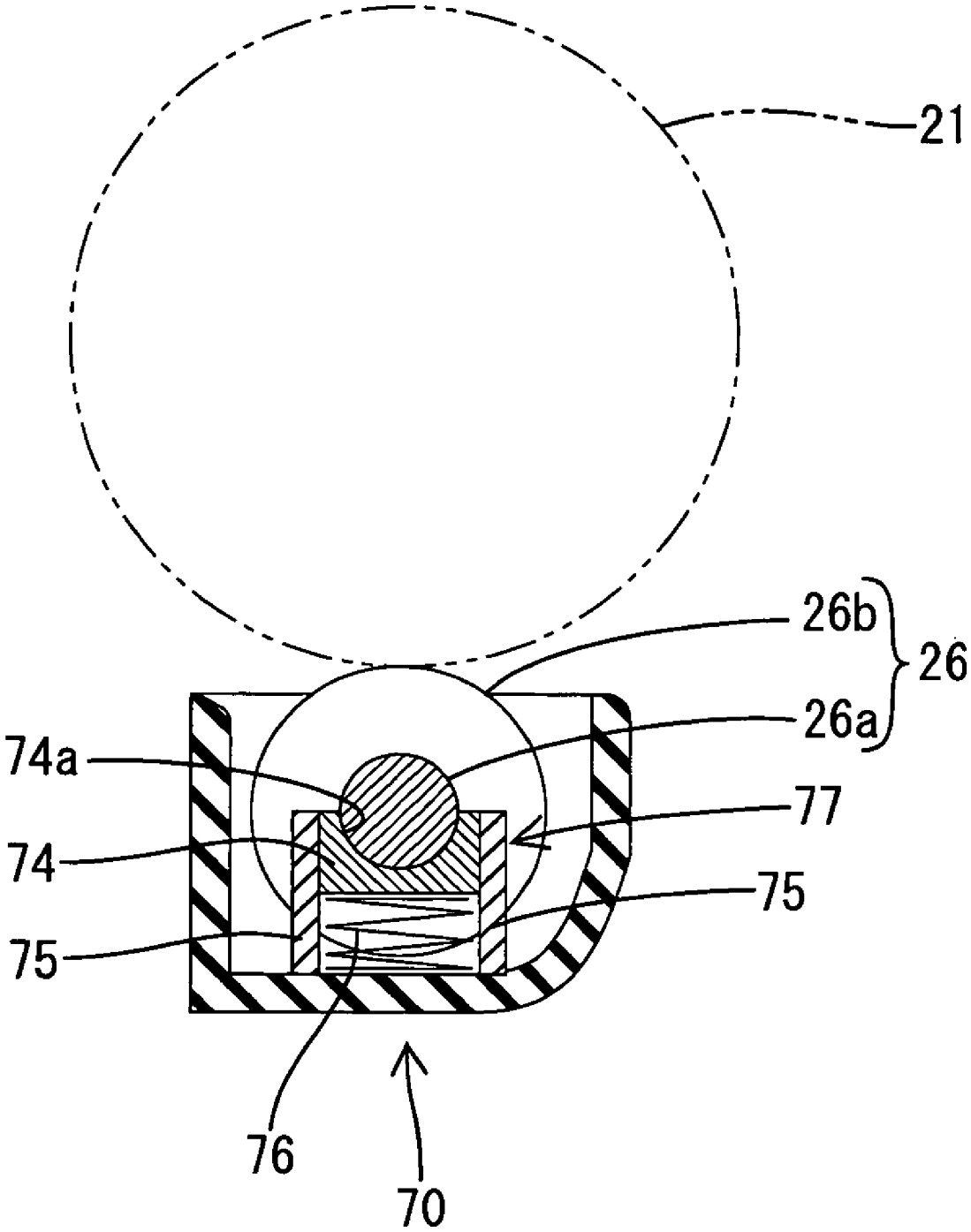
FIG. 10 is a cross sectional view of an exemplary shaft receiving mechanism.

In the exemplary embodiment illustrated in FIGS. 8–10, the pressing members 67 of the exemplary embodiment illustrated in FIGS. 1–7 are not provided on the accommodating portion 63. Instead of the pressing member 67, as shown in FIG. 10, in this exemplary embodiment, an urging device is provided on the holder 71 of the transfer roller unit 70. A shaft receiving mechanism 77 (as a shaft receiving portion) is provided on each of left and right end portions of the holder 71. The shaft receiving mechanisms 77 receive the end portions of the roller shaft 26*a* of the transfer roller 26. Each of the shaft receiving mechanisms 77 includes a shaft receiving member 74, guide walls 75, and a spring 76. The shaft receiving member 74 has a recess 74*a*, which coincides with a cross-sectional shape of at least part of the end portion of the roller shaft 26*a*.

The guide walls 75 movably support the shaft receiving member 74 such that the shaft receiving member may move up and down relative to the guide walls 75. The spring 76 is provided between the shaft receiving member 74 and a bottom surface of the holder 71 to urge the shaft receiving member 74 upward. With this structure, the transfer roller 26 of the transfer roller unit 70, which is accommodated in the accommodating portion 63, is urged upward by the spring 76, so that the transfer roller 26, which is disposed at the transfer position X, can be pressed against the photosensitive drum 21 of the process cartridge 12, which is disposed at the image forming position Y above the transfer roller 26.

According to the exemplary embodiment shown in FIGS. 8–10, the insertion holes 72 provided in the holder 71 of the transfer roller unit 70 and the engaging protrusions 80 provided to the process cartridge 12 function as a connecting device. With this structure, the connecting device can be achieved without using magnets, which are used in the exemplary embodiment shown in FIGS. 1–7.

The shaft receiving mechanism 77 of the holder 71 of the transfer roller unit 70 is provided with the spring 76 in order to press the transfer roller 26 against the photosensitive drum 21. With this structure, the transfer roller 26 is pressed against the photosensitive drum 21 in the state where the transfer roller unit 40 and the process cartridge 12 are attached to the body casing 2, so that the high quality images can be formed.

In the above-described exemplary embodiments, the transfer roller unit 40, 70 includes the holder 41, 71. The transfer roller unit is not, however, limited to the transfer roller unit including the holder. In some embodiments, the transfer roller unit may not include a holder and the transfer roller 26 itself may attach to and detach from the accommodating portion 63 of the body casing 2 by way of the roller shaft 26*a*, for example. In such embodiments, for example, shaft receiving portions may be provided on the accommodating portion 63 in order to rotatably support the end portions of the roller shaft 26*a* of the transfer roller 26. In such embodiments, the connection of the process cartridge 12 and the transfer roller 26 may be achieved by a holding mechanism that can hold and release the end portions of the roller shaft 26*a* of the transfer roller 26 during a respective connecting (i.e. an operation to connect the transfer roller 26 to the process cartridge 12) or releasing operation (i.e. an operation to release the transfer roller 26 from the process cartridge 12).

The holders 41, 71 of the exemplary embodiments include the pair of shaft receiving portions and a connecting portion, which connects the shaft receiving portions with each other, such that the shaft receiving portions and the connecting portion are integrated with each other. In some embodiments, the pair of shaft receiving portions may be separately provided and may be separately connected to the process cartridge 12.

The ribs 66 extending along the conveying path 57 are provided as the sheet 3 guiding portion. In some embodiments, the guiding portion may be, for example, a roller, which rotates about a rotating shaft extending in a direction substantially perpendicular to the conveying path 57.

In the above-described exemplary embodiments, the movement of the guiding/restricting member 64 between the restricted and released positions is achieved by manually moving the support arms 65 up and down. The way of moving the guiding/restricting member 64 between the restricted and released positions is not limited to the above method. For example, in some embodiments, a detection signal may be outputted when, for example, the end of the life of the transfer roller 26 is detected by a sensor or an operation signal is outputted when a predetermined operation is performed at an operating portion provided on the body casing 2. In accordance with the outputted detection signal or the outputted operation signal, the guiding/restricting member 64 may be automatically moved, for example, up and down by a motor.

In the above-described exemplary embodiments, the guiding/restricting member 64 is provided in the laser printer 1.

In some embodiments, a control member for controlling a state of the connection between a process cartridge and a transfer device unit may be provided, for example, on the process cartridge and/or the transfer device. For example, the control member may be controlled to maintain, create and/or release the connection between the transfer device unit and the process cartridge when the transfer device and the process cartridge are arranged in the laser printer. The control member is preferably provided on a portion of the process cartridge and/or transfer device unit such that the control member may be easily accessed and controlled when the process cartridge and/or the transfer device unit are arranged in the laser printer. The control member may, for example, be an extended member that can be moved between an extended and a retracted position. When the control member is in the extended position, the control member extends beyond a portion of the process cartridge and/or the transfer device unit and engages with the transfer device unit and/or the process cartridge, respectively. When the control member is in the retracted position, the control member does not engage with the transfer device unit or the process cartridge.

In some embodiments, the image holding body may include an intermediate transfer body as well as the photosensitive drum (the photosensitive body).

The image forming apparatus is not limited to a laser printer. In some embodiments, the image forming apparatus may be a copying machine, a facsimile machine or a multifunctional machine having a printing function and a scanning function.

In some embodiments, the transfer roller unit may be a transfer roller itself, including a transfer roller shaft, or a transfer roller unit including a transfer roller and a holder that rotatably holds end portions of the transfer roller.

In various embodiments, each pair of connecting members connectable with each other by magnetic force may include, for example, a pair of a north pole magnet and a south pole magnet, and a pair of a magnet and a metal member.

In some embodiments employing the transfer roller unit including the holder that rotatably holds the end portions of the transfer roller, the holder may be a pair of shaft receiving members that holds both end portions of the rotating shaft member of the transfer roller or a member in which the pair of shaft receiving members and the connecting member connecting the shaft receiving members are integrated with each other.

According to the above-described exemplary structure, for example, when only the transfer roller unit is removed and/or replaced with a new one, the process cartridge is detached from the body casing through the opening, and the transfer roller unit which is connected with the process cartridge can be removed therefrom. Then, a new transfer roller unit is connected to the process cartridge with replacing for the transfer roller unit whose life ended. After that, the process cartridge connected with the new transfer roller unit is inserted into the body casing through the opening and attached to the image forming position. Thus, the transfer roller unit can be easily attached to the transfer position.

In some embodiments, the connecting device includes connecting members that connect with each other by a magnetic force.

In some embodiments, the connecting device includes connecting members with engaging protrusions and/or insertion holes for receiving the engaging protrusions. The engaging protrusion may, for example, extend in the process cartridge attaching/removing direction, and may be provided on, for example, the holder of the transfer roller unit and/or the process cartridge. The insertion holes, into which the engaging protrusions are press-fitted in the attaching/removing direction, may be provided on another of the holder of the transfer roller unit and the process cartridge. With this structure, the connecting device can be accomplished without employing magnets.

The release device is provided in order to release the connection achieved by the connecting device while the transfer roller unit is left at the transfer position. Accordingly, when only the process cartridge is replaced with a new one, the transfer roller unit is separated from the process cartridge by the release device, so that only the process cartridge can be removed from the body casing while the transfer roller unit is left at the transfer position. In this case, it is not necessary for the transfer roller unit to be detached to and attached from the process cartridge unless the transfer roller unit itself needs to be replaced with a new one. Thus, the risk of damage to the surface of the transfer roller caused by scratches or fingerprints can be minimized.

When only the process cartridge is replaced with a new one, the movement of the transfer roller unit in the detaching direction is restricted by positioning the restricting member at the restricting position. When the transfer roller unit is replaced with a new one, the movement of the transfer roller unit in the detaching direction is allowed by positioning the restricting member at the released position, so that the process cartridge can be removed from the body casing while connected to the transfer roller unit.

The restricting member is, for example, rotatably supported at its base end provided on the opening side and is swingable between the restricting position where the upper surface of the restricting member extends along the conveying path of the recording medium and the released position where the tip of the restricting position is inclined downward. In addition, when the restricting member is located at the restricting position, the upper surface of the restricting member functions as the guiding portion that guides the recording medium between the image holding body and the transfer roller.

The urging member, which presses the transfer roller unit, at the transfer position, against the image holding body of the process cartridge attached to the image forming position, is provided on the body casing side. The urging device, which presses the transfer roller against the image holding body, is provided on the shaft receiving portion of the holder of the transfer roller unit. With this structure, the transfer roller is pressed against the image holding body while the transfer roller unit and the process cartridge are attached to the body casing so that the image formation can be achieved with excellent quality.

In the above description, a component is referred to as being attachable/detachable if the component can be easily attached/detached to another component without requiring, for example, excessive assembly or disassembly of the components in order to attach/detach the component from the other component. Thus, while a component may be referred to as being undetachable, the component may be detached if, for example, it is intentionally pried open or if screws, etc. are removed. Similarly, while a component may be referred to as being detachable, the component is meant to be easily detachable such as, for example, by simply being pulled out or being capable of being pulled out after a releasing means, for example, is engaged.

While the invention has been described in detail with reference to the specific embodiments thereof, it would be apparent to those skilled in the art that various changes, arrangements and modifications may be applied therein without departing from the spirit and scope of the invention.

What is claimed is:

1. A cartridge capable of attachment to and detachment from an image forming apparatus employing an attachable/detachable transfer device, the cartridge comprising:

a frame;

an image holding member rotatably supported on the frame; and a connector, provided on the frame, for detachably connecting the frame and the transfer device;

wherein the connector includes an engaging member moveable between an extended state and a retracted state and when the engaging member is in the extended state, the engaging member projects beyond a first surface of the frame, and when the engaging member is in the retracted state, the engaging member does not project beyond the first surface of the frame.

2. The cartridge of claim 1 wherein the image holding member rotates about an axis that extends in a first direction and a length of the engaging member extends in a direction that is substantially perpendicular to the first direction.

3. The cartridge of claim 1, wherein the connector includes a receiving opening.

4. The cartridge of claim 1, wherein the connector includes at least one of a magnet and a metal member.

5. A transfer device capable of attachment to and detachment from an image forming apparatus, the image forming apparatus employing an attachable/detachable cartridge including an image holding member, the transfer device being useable for transferring a developer image formed on the image holding member onto a recording medium, the transfer device comprising:

a transfer body;

a supporting member, the supporting member supporting the transfer body; and a connector, provided on the supporting member, for detachably connecting the supporting member and the attachable/detachable cartridge wherein the connector includes an engaging member moveable between an extended state and a retracted state and when the engaging member is in the extended state, the engaging member projects beyond a first surface of the supporting member, and when the engaging member is in the retracted state, the engaging member does not project beyond the first surface of the supporting member.

6. The device of claim 5 wherein the transfer body rotates about an axis that extends in a first direction and a length of the engaging member extends in a direction that is substantially perpendicular to the first direction.

7. The device of claim 5, wherein the connector includes a receiving opening.

8. The device of claim 5, wherein the connector includes at least one of a magnet and a metal member.

9. The device of claim 5, further including an urging device for urging the transfer body against the image holding member.

10. An image forming apparatus comprising:

a process cartridge including an image holding member, the process cartridge being attachable to and detachable from the image forming apparatus, and having a first connector portion;

a transfer device including a transfer body having a shaft, for transferring a developer image formed on the image holding member to a recording medium, a supporting member, and a second connector portion, the supporting member including a holder that encloses at least a part of the transfer body, and an urging member for urging the transfer body against the image holding member when the transfer device is arranged at a transfer position in the image forming apparatus and the image holding member is arranged at an image forming position in the image forming apparatus, the urging member being disposed between the holder and the transfer body shaft, wherein:

the transfer device is attachable to and detachable from the image forming apparatus, and the first connector portion is connectable to the second connector portion for detachably attaching the transfer device to the process cartridge.

11. The image forming apparatus of claim 10, further comprising a restricting member for restricting movement of the transfer device in at least one direction.

12. The image forming apparatus of claim 11, wherein the restricting member is moveable between an engaged position and a disengaged position, when the restricting member is in the engaged position, the restricting member restricts movement of the transfer device in the at least one direction, and when the restricting member is in the disengaged position, the restricting member is arranged so as to allow the transfer device to move in the at least one direction.

13. The image forming apparatus of claim 12, wherein when the restricting member is in the engaged position, a surface of the restricting member defines a portion of a conveying path for the recording medium.

14. The image forming apparatus of claim 13, wherein the surface of the restricting member includes a plurality of projecting ribs for guiding the recording medium through the conveying path.

15. The image forming apparatus of claim 12, further comprising a transfer device accommodating portion within the image forming apparatus, the transfer device accommodating portion being where the transfer device is to be accommodated.

16. The image forming apparatus of claim 15, wherein the transfer device accommodating portion includes a first wall and a second wall wherein a first end of the first wall and a first end of the second wall are connected so as to form a 90 degree or about a 90 degree angle.

17. The image forming apparatus of claim 16, wherein when the transfer device is arranged in the image forming apparatus, the transfer device is arranged on the second wall.

18. The image forming apparatus of claim 17, wherein when the restricting member is in the engaged position, the restricting member is substantially parallel to the second wall.

19. The image forming apparatus of claim 17, wherein when the restricting member is in the engaged position, a first end of the restricting member is a first distance away from a second end of the second wall and when the restricting member is in the disengaged position, the first end of the restricting member is a second distance away from the second end of the second wall, and the first distance is greater than the second distance.

20. The image forming apparatus of claim 10, wherein:

the first connector portion includes at least one of a magnet or a metal member, and the second connector portion includes at least one of the other of the magnet or the metal member.

21. The image forming apparatus of claim 10, wherein:

the first connector portion includes at least one of an engaging projection or a receiving opening, and the second connector portion includes at least one of the other of the engaging projection or the receiving opening.

22. The image forming apparatus of claim 10, wherein the transfer device further includes the urging member.

23. An image forming apparatus for use with a recording medium, comprising:

a detachable process cartridge including an image holding member and a first connector;

a detachable transfer device, including a transfer body, that transfers a developer image formed on the image holding member to the recording medium, and a second connector, the first and second connectors being engageable to connect the process cartridge to the transfer device, and being disengageable to disconnect the process cartridge from the transfer device; and an urging member that urges the transfer device toward the process cartridge, the urging member including an accommodating portion having a substantially vertically oriented supporting wall and a substantially horizontally oriented supporting wall, the urging member also including a pressing member on the substantially horizontally oriented supporting wall, at least a portion of the transfer device being disposed within a space defined between the substantially vertically oriented supporting wall and the substantially horizontally oriented supporting wall.

24. The image forming apparatus according to claim 23, further comprising a restricting member for restricting movement of the transfer device in at least one direction.

25. The image forming apparatus according to claim 24, wherein the restricting member is moveable between an engaged position and a disengaged position, when the restricting member is in the engaged position, the restricting member restricts movement of the transfer device in the at least one direction, and when the restricting member is in the disengaged position, the restricting member is arranged so as to allow the transfer device to move in the at least one direction.

26. The image forming apparatus according to claim 25, the urging member including a rectangular metal member bent so as to form a V-like shape.

* * * * *